US009856851B2

(12) United States Patent
Kato et al.

(10) Patent No.: US 9,856,851 B2
(45) Date of Patent: Jan. 2, 2018

(54) OPPOSED SWASH PLATE TYPE FLUID PRESSURE ROTATING MACHINE

(71) Applicant: KAYABA INDUSTRY CO., LTD., Tokyo (JP)

(72) Inventors: Hiroki Kato, Tokyo (JP); Takeru Hosokawa, Kanagawa (JP)

(73) Assignee: KYB Corporation, Tokyo (JP)

( * ) Notice: Subject to any disclaimer, the term of this patent is extended or adjusted under 35 U.S.C. 154(b) by 260 days.

(21) Appl. No.: 14/430,976

(22) PCT Filed: Mar. 6, 2014

(86) PCT No.: PCT/JP2014/055873
§ 371 (c)(1),
(2) Date: Mar. 25, 2015

(87) PCT Pub. No.: WO2014/156547
PCT Pub. Date: Oct. 2, 2014

(65) Prior Publication Data

US 2015/0260153 A1 Sep. 17, 2015

(30) Foreign Application Priority Data

Mar. 29, 2013 (JP) ..... 2013-073465

(51) Int. Cl.
*F03C 1/00* (2006.01)
*F03C 1/06* (2006.01)
(Continued)

(52) U.S. Cl.
CPC ..... *F03C 1/0639* (2013.01); *F03C 1/0652* (2013.01); *F03C 1/0668* (2013.01);
(Continued)

(58) Field of Classification Search
CPC .... F04B 1/2007; F04B 1/2078; F04B 1/2071; F04B 1/0856; F03C 1/0668; F03C 1/0639; F03C 1/0676
(Continued)

(56) References Cited

U.S. PATENT DOCUMENTS 3,382,793 A * 5/1968 Gantzer ..... F01B 3/0041 91/499
3,384,028 A 5/1968 Thoma
(Continued)

FOREIGN PATENT DOCUMENTS

DE 2124645 A1 11/1972
DE 69301286 T2 6/1996
(Continued)

*Primary Examiner* — Charles Freay
*Assistant Examiner* — Christopher Bobish
(74) *Attorney, Agent, or Firm* — Rabin & Berdo, P.C.

(57) ABSTRACT

An opposed swash plate type fluid pressure rotating machine in which a first piston and a second piston projecting from opposite ends of a cylinder block reciprocate in a cylinder, respectively following a first swash plate and a second swash plate includes a center spring for biasing the cylinder block toward the second swash plate. A housing hole (biasing force receiving part) for receiving a biasing force of the center spring is formed on one end part of the cylinder block. The tip of a second neck (reaction force receiving part) for receiving a reaction force from the second swash plate is formed on the other end part of the cylinder block. The cylinder block is biased only toward the second swash plate by the center spring.

6 Claims, 1 Drawing Sheet

(51) Int. Cl.

| | |
|---|---|
| ***F04B 27/08*** | (2006.01) |
| ***F04B 1/02*** | (2006.01) |
| ***F04B 1/20*** | (2006.01) |
| ***F03C 1/32*** | (2006.01) |

(52) U.S. Cl.
CPC ..... *F03C 1/0676* (2013.01); *F04B 1/02* (2013.01); *F04B 1/2035* (2013.01); *F04B 1/2078* (2013.01); *F04B 27/0817* (2013.01)

(58) Field of Classification Search
USPC ..... 417/269, 487; 91/501
See application file for complete search history.

(56) References Cited

U.S. PATENT DOCUMENTS

| | | | | | |
|---|---|---|---|---|---|
| 3,522,759 | A * | 8/1970 | Martin | F01B 3/0041 | 91/507 |
| 3,783,744 | A * | 1/1974 | Benkovic | F04B 1/20 | 91/487 |
| 3,807,283 | A | 4/1974 | Alderson et al. | | |
| 4,252,051 | A * | 2/1981 | Sato | F04B 1/126 | 91/499 |
| 4,478,134 | A * | 10/1984 | Kawahara | F04B 1/2092 | 91/488 |
| 4,602,554 | A * | 7/1986 | Wagenseil | F04B 1/2007 | 91/486 |
| 4,771,676 | A * | 9/1988 | Matsumoto | F04B 1/2007 | 417/269 |
| 5,220,225 | A | 6/1993 | Moon, Jr. | | |
| 5,520,088 | A * | 5/1996 | Dixen | F04B 1/126 | 91/499 |
| 5,862,704 | A * | 1/1999 | Seljestad | F04B 1/2085 | 74/60 |
| 7,021,904 | B2 * | 4/2006 | Shimizu | F01B 3/0035 | 417/269 |
| 2005/0095144 | A1 | 5/2005 | Shimizu | | |
| 2005/0123412 | A1 | 6/2005 | Shimizu | | |
| 2013/0327208 | A1 * | 12/2013 | Ohno | F03C 1/0639 | 91/505 |

FOREIGN PATENT DOCUMENTS

| | | | | |
|---|---|---|---|---|
| DE | 602004001946 | T2 | | 12/2006 |
| DE | 602004003761 | T2 | | 4/2007 |
| EP | 2650538 | A1 | | 10/2013 |
| JP | 62-048971 | A | | 3/1987 |
| JP | 08086273 | A | * | 4/1996 |
| JP | 2005-105898 | A | | 4/2005 |
| JP | 2005-105899 | A | | 4/2005 |
| JP | 2005-105900 | A | | 4/2005 |
| WO | WO 2012-077157 | A1 | | 6/2012 |

* cited by examiner

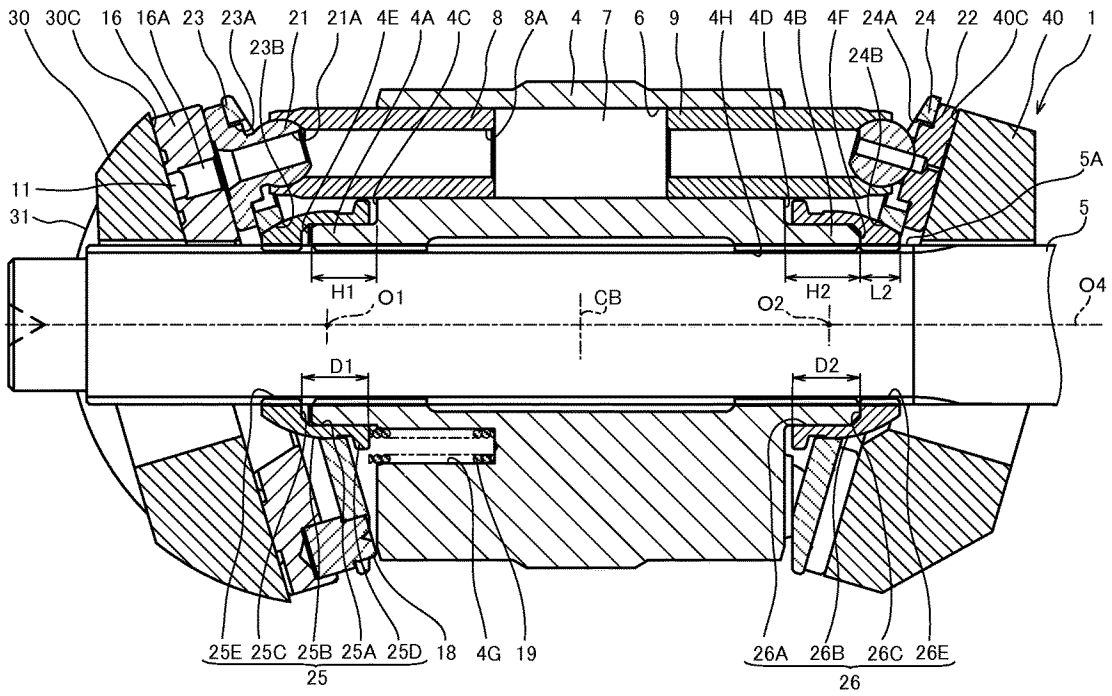
1
40
40C
22
24
24A
24B
4F
4B
4D
4H
9
6
7
4
8A
8
4C
4A
4E
21A
21
23B
23A
23
16A
16
30C
30
11
31
5A
5
O4
L2
H2
O2
D2
CB
H1
O1
D1
26E
26C
26B
26A
26
19
4G
18
25D
25A
25B
25C
25E
25

OPPOSED SWASH PLATE TYPE FLUID PRESSURE ROTATING MACHINE

TECHNICAL FIELD

The prevent invention relates to an opposed swash plate type fluid pressure rotating machine such as an opposed swash plate type piston pump or an opposed swash plate type piston motor including a first swash plate and a second swash plate facing opposite ends of a cylinder block.

BACKGROUND ART

JP2005-105899A discloses an opposed swash plate type fluid pressure rotating machine provided with a cylinder block including a plurality of cylinders, first pistons and second pistons projecting from opposite ends of the cylinders and a first swash plate and a second swash plate with which projecting ends of the first and second pistons respectively slide in contact.

In the fluid pressure rotating machine, according to the rotation of the cylinder block, the first pistons reciprocate in the cylinders, following the first swash plate, and the second pistons reciprocate in the cylinders, following the second swash plate, whereby working fluid is supplied to and discharged from volume chambers in the cylinders.

A plurality of center springs are interposed in a compressed manner between one end of the cylinder block and the first swash plate and a plurality of center springs are interposed in a compressed manner between the other end of the cylinder block and the second swash plate. The projecting ends of the first and second pistons are respectively pressed against the first and second swash plates by the center springs.

The cylinder block is supported on a rotary shaft movably in an axial direction via splines. The cylinder block is arranged between the first and second swash plates to be sandwiched between pairs of center springs.

SUMMARY OF INVENTION

In the fluid pressure rotating machine disclosed in JP2005-105899A, if a force received by the first swash plate from the center springs and the first pistons and a force received by the second swash plate from the center springs and the second pistons are unbalanced, the cylinder block may move in the axial direction or vibrate.

If the cylinder block moves in the axial direction or vibrates, biasing forces of the center springs vary, wherefore the first and second pistons cannot follow the first and second swash plates and are separated from the swash plates. If the pistons are separated from the swash plates, working fluid leaks. Thus, efficiency in supplying and discharging the working fluid is reduced.

The present invention aims to prevent a movement of a cylinder block in an axial direction in an opposed swash plate type fluid pressure rotating machine.

According to one aspect of the present invention, an opposed swash plate type fluid pressure rotating machine in which a first piston and a second piston projecting from opposite ends of a rotary cylinder block reciprocate in a cylinder, respectively following a first swash plate and a second swash plate is provided. The fluid pressure rotating machine includes a center spring for biasing the cylinder block toward the first or second swash plate. A biasing force receiving part for receiving a biasing force of the center spring is formed on one end part of the cylinder block. A reaction force receiving part for receiving a reaction force from the first or second swash plate is formed on the other end part of the cylinder block. The cylinder block is biased only toward the first or second swash plate by the center spring.

BRIEF DESCRIPTION OF DRAWING

FIG. 1 is a sectional view of an opposed swash plate type fluid pressure rotating machine according to an embodiment of the present invention.

DESCRIPTION OF EMBODIMENT

A case where an opposed swash plate type fluid pressure rotating machine according to an embodiment of the present invention is applied to a hydrostatic transmission (HST) mounted as a continuously variable transmission in a working vehicle or the like is described with reference to FIG. 1.

As shown in FIG. 1, an opposed swash plate type piston motor 1 includes a shaft 5 which rotates about an axis O4, a cylinder block 4 which is supported on the shaft 5 and a first swash plate 30 and a second swash plate 40 which are tilted while facing opposite ends of the cylinder block 4.

Opposite end parts of the cylindrical shaft 5 are rotatably supported on a casing (not shown) via bearings (not shown).

The cylinder block 4 is formed into a cylindrical tube including a hollow part into which the shaft 5 is fitted. In the cylinder block 4, a plurality of cylinders 6 are arranged side by side in a circumferential direction. The cylinders 6 are formed to extend in an axial direction and open on opposite end surfaces 4C, 4D of the cylinder block 4.

It should be noted that the "circumferential direction" means a direction of a circumference centered on the axis O4 of the cylinder block 4 and the "axial direction" means an extending direction of the axis O4.

A first piston 8 and a second piston 9 are respectively inserted into the cylinder 6 from opposite opening ends. The first and second pistons 8, 9 include tip parts projecting from the opening ends of the cylinder 6 and a first shoe 21 and a second shoe 22 are pivotably coupled to the respective tip parts.

When the cylinder block 4 rotates, the first piston 8 reciprocates following the first swash plate 30 via the first shoe 21 and a port plate 16, and the second piston 9 reciprocates following the second swash plate 40 via the second shoe 22.

In the cylinder 6, a volume chamber 7 is defined between the first and second pistons 8, 9. The volume chamber 7 expands and contracts by the reciprocation of the first and second pistons 8, 9 in the cylinder 6, whereby hydraulic oil is supplied to and discharged from the volume chamber 7 through a pair of supply/discharge passages 11.

Although the piston motor 1 uses the hydraulic oil (oil) as the working fluid, water-soluble alternative liquid or the like may be, for example, used instead of the hydraulic oil.

Each of the pair of supply/discharge passages 11 is formed by a piston port 8A formed on the first piston 8, a shoe port 21A formed on the first shoe 21, a port 16A formed on a port plate 16, a pair of swash plate ports (not shown) formed on the first swash plate 30 and a pair of casing ports (not shown) open on the casing.

Hydraulic oil supplied into the volume chamber 7 through one supply/discharge passage 11 reaches the volume chamber 7 from one casing port through one swash plate port, the port 16A, the shoe port 21A and the piston port 8A.

The hydraulic oil discharged from the volume chamber 7 through the other supply/discharge passage 11 reaches the other casing port from the volume chamber 7 through the piston port 8A, the shoe port 21A, the port 16A and the other swash plate port.

By a pressure of the hydraulic oil introduced to each volume chamber 7, the first piston 8 pushes the first swash plate 30 and the second piston 9 pushes the second swash plate 40. At this time, the cylinder block 4 and the shaft 5 are driven to rotate by circumferential components of reaction forces received by the first pistons 8 from the first swash plate 30 and reaction forces received by the second pistons 9 from the second swash plate 40.

The piston motor 1 includes tilt supporting mechanisms for tiltably supporting the first and second swash plates 30, 40. The first swash plate 30 is supported rotatably about a tilt axis O1. The second swash plate 40 is supported rotatably about a tilt axis O2. The tilt axes O1, O2 are orthogonal to the axis O4 of the cylinder block 4.

The tilt supporting mechanism for the first swash plate 30 includes a pair of tilt shaft parts 31 provided on a rear surface side of the first swash plate 30 and tilt bearings (not shown) provided on the casing. The tilt shaft part 31 is in the form of a semi-cylinder projecting from the rear surface side of the first swash plate 30. The tilt bearing includes a bearing surface curved along the outer peripheral surface of the tilt shaft part 31. The tilt supporting mechanism for the second swash plate 40 is similarly configured to that for the first swash plate 30.

The piston motor 1 includes servo mechanisms (not shown) for respectively tilting the first and second swash plates 30, 40. By respectively tilting the first and second swash plates 30, 40, reciprocating stroke lengths of the first and second pistons 8, 9 in the cylinders 6 change to change a displacement volume per rotation of the cylinder block 4.

Next, a configuration for supporting the cylinder block 4 on the shaft 5 is described.

A spline 5A is formed on the outer periphery of the shaft 5. A spline 4H is formed on the inner periphery of the cylinder block 4. By slidably fitting the spline 4H of the cylinder block 4 to the spline 5A of the shaft 5, the rotation of the cylinder block 4 relative to the shaft 5 is regulated and the cylinder block 4 can move in the axial direction relative to the shaft 5.

A first retainer plate 23 and a first retainer holder 25 are interposed side by side in the axial direction between the first swash plate 30 and the cylinder block 4.

The disk-shaped first retainer plate 23 is arranged to face a swash plate front surface 30C of the first swash plate 30. A plurality of insertion holes 23A into which the first shoe 21 is inserted are formed side by side in the circumferential direction on the first retainer plate 23. A center hole 23B engaged with the first retainer holder 25 is formed in a central part of the first retainer plate 23.

The disk-shaped port plate 16 which rotates together with the cylinder block 4 is provided between the first shoe 21 and the first swash plate 30. The port plate 16 is coupled to the first retainer plate 23 via a plurality of pins 18.

The first retainer holder 25 is formed into a hollow cylinder to be fitted to the cylinder block 4 and the shaft 5. A spline 25E is formed on the inner periphery of the first retainer holder 25. By slidably fitting the spline 25E of the first retainer holder 25 to the spline 5A of the shaft 5, the rotation of the first retainer holder 25 relative to the shaft 5 is regulated and the first retainer holder 25 can move in the axial direction relative to the shaft 5.

The first retainer holder 25 includes a spherical tip part 25B, which is slidably fitted into the center hole 23B of the first retainer plate 23.

A second retainer plate 24 and a second retainer holder 26 are interposed side by side in the axial direction between the second swash plate 40 and the cylinder block 4.

The disk-shaped second retainer plate 24 is arranged to face a swash plate front surface 40C of the second swash plate 40. A plurality of insertion holes 24A into which the second shoe 22 is inserted are formed side by side in the circumferential direction on the second retainer plate 24. A center hole 24B engaged with the second retainer holder 26 is formed in a central part of the second retainer plate 24.

The second retainer holder 26 is formed into a hollow cylinder to be fitted to the cylinder block 4 and the shaft 5. A spline 26E is formed on the inner periphery of the second retainer holder 26. By slidably fitting the spline 26E of the second retainer holder 26 to the spline 5A of the shaft 5, the rotation of the second retainer holder 26 relative to the shaft 5 is regulated and the second retainer holder 26 can move in the axial direction relative to the shaft 5.

The second retainer holder 26 includes a spherical tip part 26B, which is slidably fitted into the center hole 24B of the second retainer plate 24.

The spherical tip parts 25B, 26B are so formed that centers of curvature thereof are located at the same positions as the tilt axes O1, O2 in a state where the first and second retainer holders 25, 26 are mounted at predetermined positions. When the first and second swash plates 30, 40 pivot about the tilt axes O1, O2 together with the first and second retainer plates 23, 25, the tip parts 25B, 26B of the first and second retainer holders 25, 26 slide in contact with the center holes 23B, 24B, wherefore the first and second retainer holders 25, 26 do not move outward in the axial direction.

The piston motor 1 includes a cylinder block supporting mechanism for supporting the cylinder block 4 at a predetermined position in the axial direction of the shaft 5. The cylinder block 4 is arranged at the predetermined position set between the first and second swash plates 30, 40 by the cylinder block supporting mechanism.

The cylinder block supporting mechanism includes a plurality of center springs 19 interposed between the first retainer holder 25 and the cylinder block 4. The center springs 19 are provided only on one end side of the cylinder block 4, but not on the other end side of the cylinder block 4.

By the center springs 19, the first shoe 21 is pressed toward the first swash plate 30 via the first retainer holder 25 and the first retainer plate 23 and the second shoe 22 is pressed toward the second swash plate 40 via the cylinder block 4, the second retainer holder 26 and the second retainer plate 24.

A plurality of housing holes 4G are formed on a left end part of the cylinder block 4 in FIG. 1. The housing holes 4G are formed to extend in the axial direction and open on an end surface 4C of the cylinder block 4. The housing holes 4G are formed side by side in a circumferential direction of the cylinder block 4.

An annular brim part 25D is formed on an end part of the first retainer holder 25. The brim part 25D is facing opening ends of the housing holes 4G formed on the cylinder block 4.

The coiled center springs 19 are interposed in a compressed manner between the brim part 25D and bottom parts of the housing holes 4G. That is, the housing holes 4G are for housing the center springs 19 and the bottom parts thereof serve as biasing force receiving parts for receiving biasing forces of the center springs 19.

Opposite end surfaces 4C, 4D of the cylinder block 4 are formed into flat surfaces orthogonal to the axis O4. The cylinder block 4 includes a first neck part 4A and a second neck part 4B in the form of hollow cylinders projecting in the axial direction from the opposite end surfaces 4C, 4D.

The first neck part 4A projects by a projection amount H1 in the axial direction from the end surface 4C of the cylinder block 4. The second neck part 4B cylindrically projects by a projection amount H2 in the axial direction from the end surface 4D of the cylinder block 4. The projection amount H1 of the first neck part 4A is smaller than the projection amount H2 of the second neck part 4B.

The first retainer holder 25 is formed with an annular recess 25A slidably fitted to the first neck part 4A. A depth D1 of the recess 25A in the axial direction is larger than the projection amount H1 of the first neck part 4A.

Without limitation to the aforementioned configuration, the depth D1 of the recess 25A may be not larger than the projection amount H1 of the first neck part 4A. When the first retainer holder 25 is biased leftward in FIG. 1 by the center springs 19, a step part 25C formed at the back of the recess 25A is separated from a tip 4E of the first neck part 4A and the brim part 25D is separated from the end surface 4C of the cylinder block 4.

The second retainer holder 26 is formed with an annular recess 26A slidably fitted to the second neck part 4B. A depth D2 of the recess 26A in the axial direction is smaller than the projection amount H2 of the second neck part 4B.

When the second retainer holder 26 is biased rightward in FIG. 1 by the center springs 19, a step part 26C formed at the back of the recess 26A comes into contact with a tip 4F of the second neck part 4B. That is, the tip 4F of the second neck part 4B serves as a reaction force receiving part at which the cylinder block 4 pushed in the axial direction by the center springs 19 receives a reaction force in the axial direction from the second retainer holder 26.

The first and second retainer holders 25, 26 are identically shaped and sized to use parts in common between the both.

The cylinder block 4 is biased rightward in FIG. 1 by the center springs 19 and pressed against the second swash plate 40 via the second retainer holder 26, the second retainer plate 24 and the second shoe 22. As a result, the axial position of the cylinder block 4 relative to the second swash plate 40 is determined.

By arbitrarily setting a length H2 of the second neck part 4B in the axial direction, the axial position of the cylinder block 4 relative to the second swash plate 40 is determined.

The cylinder block 4 is arranged in the center between the first and second swash plates 30, 40. That is, the cylinder block 4 is so arranged that a cylinder block center line CB bisecting the cylinder block 4 in the axial direction is equidistant to the tilt axis O1 of the first swash plate 30 and the tilt axis O2 of the second swash plate 40. Without limitation to this configuration, the cylinder block 4 is so arranged that the cylinder block center line CB is at different distances from the tilt axis O1 of the first swash plate 30 and the tilt axis O2 of the second swash plate 40.

Next, the operation of the piston motor 1 is described.

In the piston motor 1, the hydraulic oil is supplied to and discharged from the volume chambers 7 through pairs of supply/discharge passages 11, the first pistons 8 reciprocate following the first swash plate 30 via the first shoes 21 and the port plates 16 and the second pistons 9 reciprocate following the second swash plate 40 via the second shoes 22, whereby the cylinder block 4 rotates.

The first and second pistons 8, 9 are biased in the axial direction by the working hydraulic pressures introduced to the volume chambers and the center springs 19, and reciprocate following the first and second swash plates 30, 40. The center springs 19 press the first shoes 21 against the first swash plate 30 via the port plates 16, whereby the floating of the port plates 16 from the first swash plate 30 by the working hydraulic pressures which are increased at startup is suppressed and the floating of the first shoes 21 from the port plates 16 is suppressed.

Since the cylinder block 4 is supported in the axial direction by a reaction force received from the step part 26C of the second retainer holder 26 supported on the second swash plate 40, a movement toward the second retainer holder 26 is prevented. In this way, the reciprocating stroke lengths of the first and second pistons 8, 9 following the first and second swash plates 30, 40 are kept constant. As a result, the formation of clearances between the first swash plate 30 and the port plates 16 and between the port plates 16 and the first shoes 21 is prevented and the hydraulic oil is efficiently supplied to and discharged from the volume chambers 7.

By respectively changing tilt angles of the first and second swash plates 30, 40, the reciprocating stroke lengths of the first and second pistons 8, 9 in the cylinders 6 change, a rotation speed of the cylinder block 4 is adjusted and a speed ratio of the piston motor 1 changes.

According to the above embodiment, the following functions and effects are achieved.

Since the cylinder block 4 is supported by the reaction force received from the second swash plate 40, a movement toward the second retainer holder 26 is prevented. This causes the hydraulic oil to be efficiently supplied to and discharged from the volume chambers in the cylinder block 4.

Further, since the center springs 19 are provided only on the one end side of the cylinder block 4, but not on the other end side of the cylinder block 4, the number of the center springs 19 is halved as compared with the conventional configuration in which pairs of center springs are provided at opposite ends of a cylinder block. Thus, the structure is simplified.

Further, since the cylinder block 4 is pressed against the second retainer holder 26 by the center springs 19 and supported by the reaction force received from the second swash plate 40 via the second retainer holder 26, a movement of the cylinder block 4 toward the second retainer holder 26 is prevented.

Further, since the neck part 4B projecting in the axial direction on one end of the cylinder block 4 is formed as the reaction force receiving part and the second retainer holder 26 is formed with the step part 26C that comes into contact with the tip of the neck part 4B, the axial positions of the second retainer holder 26 and the cylinder block 4 are determined.

Without limitation to the aforementioned configuration, the center springs 19 may be interposed between the second retainer holder 26 and the cylinder block 4 and the cylinder block 4 may be formed with a reaction force receiving part for receiving a reaction force in the axial direction from the first swash plate 30 via the first retainer holder 25.

Further, since the axial position of the cylinder block 4 relative to the casing is determined by the length H2 of the second neck part 4B in the axial direction, the axial position of the cylinder block 4 relative to the casing can be changed by arbitrarily setting the length H2 of the second neck part 4B in the axial direction.

Further, since the first and second retainer holders 25, 26 are identically shaped and sized, parts are used in common between the first and second retainer holders 25, 26. In this way, erroneous mounting of parts between the first and second retainer holders 25, 26 is avoided and cost of a product is reduced by reducing the types of parts.

Without limitation to the aforementioned configuration, the first and second retainer holders 25, 26 may be differently shaped. When the cylinder block 4 comes into contact with the second retainer holder 26, the axial position of the cylinder block 4 relative to the second swash plate 40 can be adjusted by changing the length L2 from the step part 26C of the second retainer holder 26 to the tip of the spherical tip part 25B.

Embodiments of the present invention were described above, but the above embodiments are merely examples of applications of the present invention, and the technical scope of the present invention is not limited to the specific constitutions of the above embodiments.

In addition to a hydraulic motor or a hydraulic pump constituting a hydrostatic transmission (HST), the opposed swash plate type fluid pressure rotating machine of the present invention can be utilized for another machine or facility.

This application claims priority based on Japanese Patent Application No. 2013-73465 filed with the Japan Patent Office on Mar. 29, 2013, the entire contents of which are incorporated into this specification.

The invention claimed is:

1. An opposed swash plate type fluid pressure rotating machine in which a first piston and a second piston projecting from opposite ends of a rotary cylinder block reciprocate in a cylinder, respectively following a first swash plate and a second swash plate, comprising:

a center spring disposed only at one end part of the cylinder block so that another end part of the cylinder block is free of a center spring, wherein:

a biasing force receiving part for receiving a biasing force of the center spring is formed on only the one end part of the cylinder block;

a reaction force receiving part for receiving a reaction force from the first or second swash plate is formed on only the other end part of the cylinder block; and the cylinder block is biased only toward one of the first and second swash plate by the center spring, the cylinder block being configured to move axially.

2. The opposed swash plate type fluid pressure rotating machine according to claim 1, comprising:

a first shoe pivotably coupled to an end part of the first piston projecting from the cylinder block;

a second shoe pivotably coupled to an end part of the second piston projecting from the cylinder block;

a first retainer plate for pressing the first shoe toward the first swash plate;

a second retainer plate for pressing the second shoe toward the second swash plate;

a first retainer holder for pivotably supporting the first retainer plate; and a second retainer holder for pivotably supporting the second retainer plate, wherein:

a part in which the center spring is disposed is formed as the biasing force receiving part on the one end part of the cylinder block; and a part for receiving a reaction force in an axial direction from the first or second retainer holder is formed as the reaction force receiving part on the other end part of the cylinder block.

3. The opposed swash plate type fluid pressure rotating machine according to claim 2, wherein:

a neck part projecting in the axial direction is formed as the reaction force receiving part on one end of the cylinder block; and the first or second retainer holder is formed with a step part which comes into contact with the tip of the neck part.

4. The opposed swash plate type fluid pressure rotating machine according to claim 2, wherein:

a neck part projecting in the axial direction is formed as the reaction force receiving part on one end of the cylinder block; and the axial position of the cylinder block is determined by a length of the neck part in the axial direction.

5. The opposed swash plate type fluid pressure rotating machine according to claim 2, wherein:

the first and second retainer holders are identically shaped and sized to each other.

6. An opposed swash plate type fluid pressure rotating machine, comprising:

a rotary cylinder block configured to move axially, having a plurality of cylinders;

a biasing force receiving part formed in only one end thereof, and a reaction force receiving part formed in only another end thereof;

a first swash plate and a second swash plate, each of which is respectively tilted and facing opposite ends of the rotary cylinder block;

a plurality of first pistons and a plurality of second pistons, each of the first pistons projecting from an end of the cylinder block, and each of the second pistons projecting from an opposite end of the cylinder block, each of said first pistons and each of said second pistons respectively following the first swash plate and the second swash plate, each of said cylinders having a respective one of said first pistons and a respective one of said second pistons therein; and at least one center spring disposed only at the one end of the rotary cylinder block so that the other end of the cylinder block is free of a center spring, the cylinder block being biased only towards one of the first and second swash plates by the at least one center spring, the biasing force receiving part for receiving a biasing force of the center spring, the reaction force receiving part for receiving a reaction force from the one of the first and second swash plates.

* * * * *